US009856777B2

(12) United States Patent
Camera et al.

(10) Patent No.: US 9,856,777 B2
(45) Date of Patent: Jan. 2, 2018

(54) DUAL CHAMBER COOLANT RESERVOIR

(71) Applicant: Toledo Molding & Die, Inc., Toledo, OH (US)

(72) Inventors: Michael Camera, Toleda, OH (US); Robert Olsen, Monroe, MI (US); James Papke, Temperance, MI (US)

(73) Assignee: Toledo Molding & Die, Inc., Toledo, OH (US)

( * ) Notice: Subject to any disclaimer, the term of this patent is extended or adjusted under 35 U.S.C. 154(b) by 40 days.

(21) Appl. No.: 14/962,825

(22) Filed: Dec. 8, 2015

(65) Prior Publication Data

US 2016/0160740 A1 Jun. 9, 2016

Related U.S. Application Data

(60) Provisional application No. 62/088,991, filed on Dec. 8, 2014.

(51) Int. Cl.

| | |
|---|---|
| ***F01P 7/14*** | (2006.01) |
| ***F01P 11/02*** | (2006.01) |
| ***B65D 51/16*** | (2006.01) |

(52) U.S. Cl.

CPC ..... *F01P 11/029* (2013.01); *F01P 11/0238* (2013.01); *F01P 11/0285* (2013.01); *F01P 11/0247* (2013.01); *F01P 2011/0252* (2013.01)

(58) Field of Classification Search

CPC ..... F01P 2011/0261; F01P 2031/16; F01P 11/029; F01P 11/0238; F01P 11/0285; F01P 11/0276; F01P 2011/0219; F01P 2011/0228; F01P 11/0214; F01P 2007/146; F01P 2011/0252; F01P 2011/0233; F01P 11/0247; B60K 2015/0344; B60K 2015/03296; B60K 2015/0358; B65D 51/1638

(Continued)

(56) References Cited

U.S. PATENT DOCUMENTS 2,006,752 A * 7/1935 Swank ..... F01P 11/0247 123/41.1
2,164,478 A * 7/1939 Smith ..... F01P 11/0238 137/493.9

(Continued)

FOREIGN PATENT DOCUMENTS

DE 19948226 4/2001
DE 102011078293 1/2013

(Continued)

*Primary Examiner* — J. Gregory Pickett
*Assistant Examiner* — Gideon Weinerth
(74) *Attorney, Agent, or Firm* — McHale & Slavin, P.A.

(57) ABSTRACT

A dual chamber coolant reservoir having a single vent neck. The coolant reservoir is for an internal combustion engine cooling system wherein the reservoir housing includes a first chamber and a second chamber formed integral thereto. A vent neck includes an aperture for accessing the first chamber with either a two or three o-ring cap to maintain pressure within the first chamber. Means for venting the second chamber when coolant exceeds a predetermined pressure level and a means for venting the first and second chamber when said cap is moved from a closed position to an open position. An inline pressure relief valve and check valve providing pressure relief and air displacement.

8 Claims, 18 Drawing Sheets

(58) Field of Classification Search
USPC ..... 220/501, 562, 564, 203, 300, 203.06, 220/203.26, DIG. 32; 123/41.54, 41.27; 165/104.32
See application file for complete search history.

(56) References Cited

U.S. PATENT DOCUMENTS 2,266,314 A * 12/1941 Eshbaugh ..... F01P 11/0238 137/493.4
3,071,285 A * 1/1963 Dawson ..... F01P 11/0238 165/72
3,163,315 A * 12/1964 Wilson ..... F01P 11/0247 220/231
3,220,597 A * 11/1965 McCamey ..... F01P 11/0247 220/212
3,700,166 A * 10/1972 Foults ..... F01P 7/16 123/41.54
3,910,451 A * 10/1975 Tusing ..... F01P 11/0238 220/203.26
4,079,855 A * 3/1978 Avrea ..... F01P 11/0238 137/493.4
4,185,751 A * 1/1980 Moore ..... F01P 11/0238 220/203.26
4,196,822 A * 4/1980 Avrea ..... F01P 11/0238 220/203.06
4,478,178 A * 10/1984 Pernet ..... F01P 11/0238 123/41.01
4,480,598 A * 11/1984 Berrigan ..... F01P 11/029 123/41.27
4,498,599 A * 2/1985 Avrea ..... F01P 11/0238 220/203.26
4,511,056 A * 4/1985 Reutter ..... F01P 11/0238 220/203.02
4,640,235 A * 2/1987 Martin ..... F01P 11/18 123/41.03
4,836,406 A * 6/1989 Benning ..... F01P 11/0238 220/203.19
5,071,020 A * 12/1991 Reutter ..... B65D 51/1644 220/203.06
5,163,506 A * 11/1992 Attinger ..... F01P 11/029 123/41.54
5,357,909 A * 10/1994 Attinger ..... F01P 11/029 123/41.54
5,522,456 A * 6/1996 Valk ..... F01P 11/0247 123/41.54
5,603,425 A * 2/1997 Breeden ..... F01P 11/0247 220/203.06
6,056,139 A * 5/2000 Gericke ..... F01P 11/0247 220/203.06
6,216,646 B1 * 4/2001 Smith ..... F01P 11/029 123/41.54
6,244,294 B1 * 6/2001 Hollis ..... F01P 11/0238 123/41.27
6,390,318 B1 * 5/2002 Tanaka ..... F01P 11/0238 165/104.32
6,742,667 B1 * 6/2004 Reutter ..... F01P 11/0247 220/288
7,383,795 B2 6/2008 Lawrence et al.
8,607,746 B2 12/2013 Hutchins
2002/0189559 A1 * 12/2002 Hewkin ..... F01P 11/0214 123/41.54
2004/0011788 A1 * 1/2004 Harris ..... F01P 11/0238 220/203.26
2004/0040966 A1 * 3/2004 Watanabe ..... F01P 11/0247 220/298
2004/0069784 A1 * 4/2004 Reutter ..... B65D 51/16 220/304
2005/0077295 A1 * 4/2005 Reutter ..... F01P 11/0247 220/288
2005/0087532 A1 * 4/2005 Geiger ..... F01P 11/0247 220/201
2006/0118067 A1 * 6/2006 Hewkin ..... F01P 11/029 123/41.54
2010/0206882 A1 * 8/2010 Wessels ..... F01P 11/029 220/562
2011/0062163 A1 3/2011 Hewkin
2015/0108138 A1 * 4/2015 Kenicke ..... B60K 15/063 220/564
2016/0146094 A1 * 5/2016 Cha ..... F01P 11/0247 123/41.08
2016/0265415 A1 * 9/2016 Won ..... F01P 11/0238
2016/0272383 A1 * 9/2016 Ramus ..... B65D 51/1638
2017/0036531 A1 * 2/2017 McLauchlan .... B60K 15/03504

FOREIGN PATENT DOCUMENTS

EP 0177860 4/1986
EP 1260685 11/2002
EP 1505273 7/2011

* cited by examiner

DUAL CHAMBER COOLANT RESERVOIR

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/088,991, entitled "DUAL CHAMBER COOLANT RESERVOIR", filed Dec. 8, 2014. The contents of the above referenced application is incorporated herein by reference.

FIELD OF THE INVENTION

This invention is directed to the field of cooling systems for internal combustion engines and all fluid cooled equipment in particular to a dual chamber coolant reservoir having a single vent neck.

BACKGROUND OF THE INVENTION

Internal combustion engines convert chemical energy, such as gasoline, into mechanical energy. An internal combustion engine compresses a mixture of air and gasoline within a cylinder by use of a piston coupled to a crankshaft. The piston is rotated into a position so as to cause an increase in the mixture density, temperature, and pressure within the cylinder wherein a high voltage electric spark causes the mixture to expand rapidly resulting in movement of the piston. As the piston is moved a connecting rod imparts a linear to rotational movement of the crankshaft to produce the mechanical energy.

The operation of the internal combustion engine involves many parts which produces heat from friction. Excess heat must be removed for engine longevity. However, for efficient operation the internal combustion engine must operate at a predetermined temperature. For this reason, most engines on a vehicle require a cooling system to regulate the engine temperature. Conventionally a radiator is located in the front of the vehicle and positioned transverse to the direction of movement of the vehicle. A radiator fan is then employed to draw air through the radiator so that cooling may be effected when the vehicle is operating at a speed where insufficient air is being driven through the radiator.

A coolant reservoir, also referred to as a coolant recovery tank, allows coolant such as a mixture of water and antifreeze to reside as it expands when heated. The coolant reservoir is typically made of plastic and constructed to allow an operator to visually check the level and condition of the coolant. Conventional coolant systems are sealed and placed under pressure. Late model vehicles pressurize the coolant reservoir essentially eliminating the need for the traditional radiator cap fill port. In this embodiment the cooling system recirculates coolant through the engine and into the radiator for dispersion of excess heat. Should the coolant become heated to the point of expansion, the coolant will expand into the coolant reservoir. This typically occurs when the engine has been turned off immediately after operating. The recirculation discontinues and the coolant reservoir accepts the expansion. As the cooling process takes place after engine shutdown, the coolant begins to shrink within the engine and creates a vacuum that draws the coolant from the reservoir back into the radiator and engine portion of the cooling system. Still more recent engines employ a dual chamber reservoir having a pressurized chamber formed integral with an overflow chamber. Such reservoirs have a pressure relief cap and a fill port cap. The problem with such systems is the cost of manufacturing a dual neck reservoir to hold two caps. Further, the caps are rated at different pressures so there is a possibility of attaching the wrong cap to the vent neck. For instance, one cap may have pressure relieve and the second has no relief. In addition, a second cap located on a coolant reservoir would be located along a side of the reservoir making it very difficult to service.

What is needed in the art is a dual chamber coolant reservoir wherein a single vent neck can be used for coolant insertion and pressure relief.

SUMMARY OF THE INVENTION

Disclosed is a dual chamber coolant reservoir having a single vent neck. The coolant reservoir is for an internal combustion engine cooling system wherein a reservoir housing includes a first chamber and a second chamber formed integral thereto. The first chamber is fluidly coupled to the second chamber by a strategically positioned first trough. A vent neck includes an aperture for accessing the first chamber with a multiple o-ring cap to maintain pressure within the first chamber. Means for venting said second chamber when coolant within the second chamber exceeds a predetermined pressure level and a means for venting said second chamber when said cap is moved from a closed position to an open position. An inline pressure relief valve and check valve providing pressure relief and air displacement.

An objective of the invention is to disclose a coolant reservoir that eliminates the need for a second vent neck and second vent cap.

Still another objective of the invention is to eliminate the need for servicing a reservoir having a side cap or accidentally switching the two caps.

Yet still another objective of the invention is to employ a single sealing cap mounted in an easily accessible position along the top surface of the reservoir using an inline valve for pressure relief, and an inline check valve for air displacement.

Still another objective of the invention is combine the functions of the pressure relieving neck through the fill cap by inclusion of an inline pressure relief valve and check valve allowing expanding fluid to be relieved while allowing air back into the reservoir without restriction.

Another objective of the invention is to teach the use of a cap mounted pressure relief valve and check valve assembly allowing a single vent port in the vent neck.

Other objectives and further advantages and benefits associated with this invention will be apparent to those skilled in the art from the description, examples and claims which follow.

DETAILED DESCRIPTION OF THE PREFERRED EMBODIMENT

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
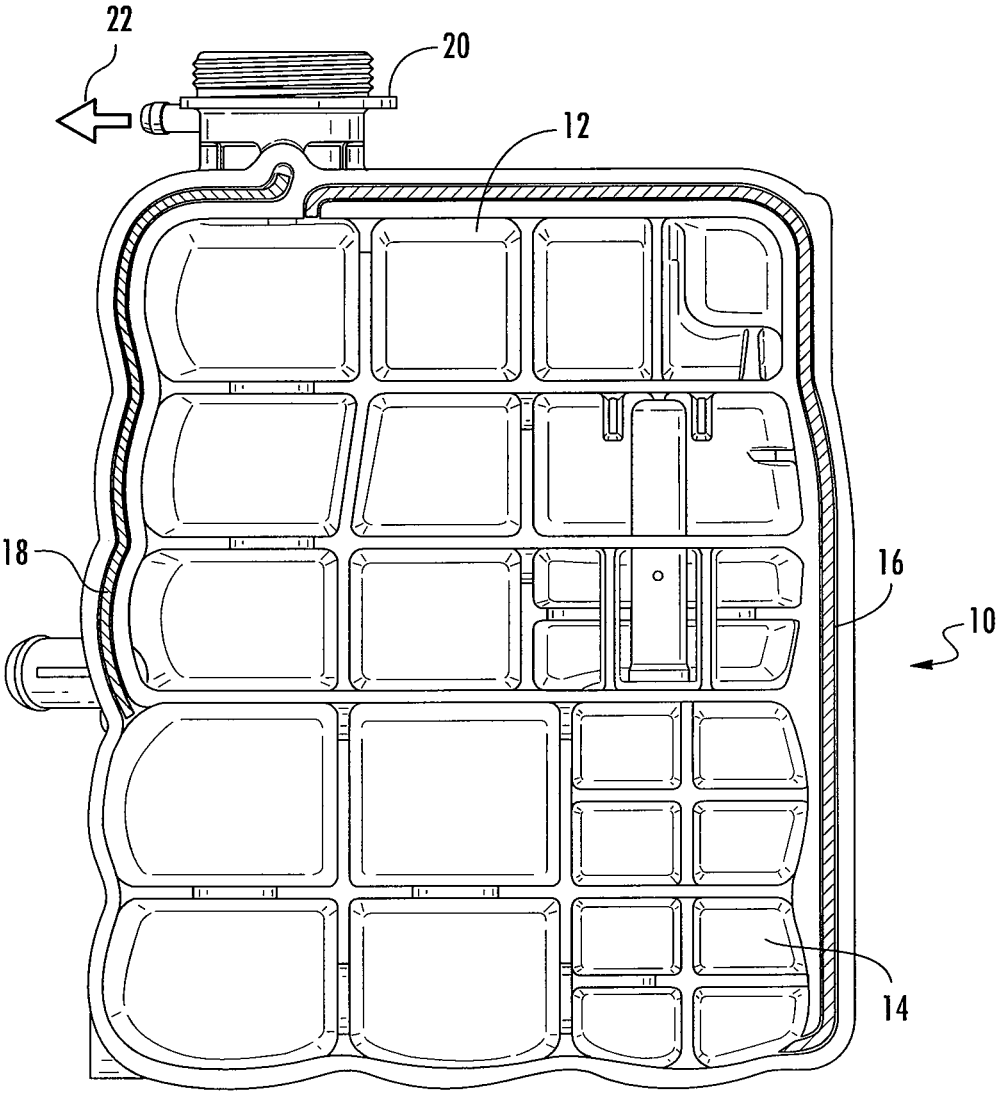
FIG. 1 (PRIOR ART)
FIG. 1 illustrates a front view of a prior art two cap coolant reservoir.
Figure 2:
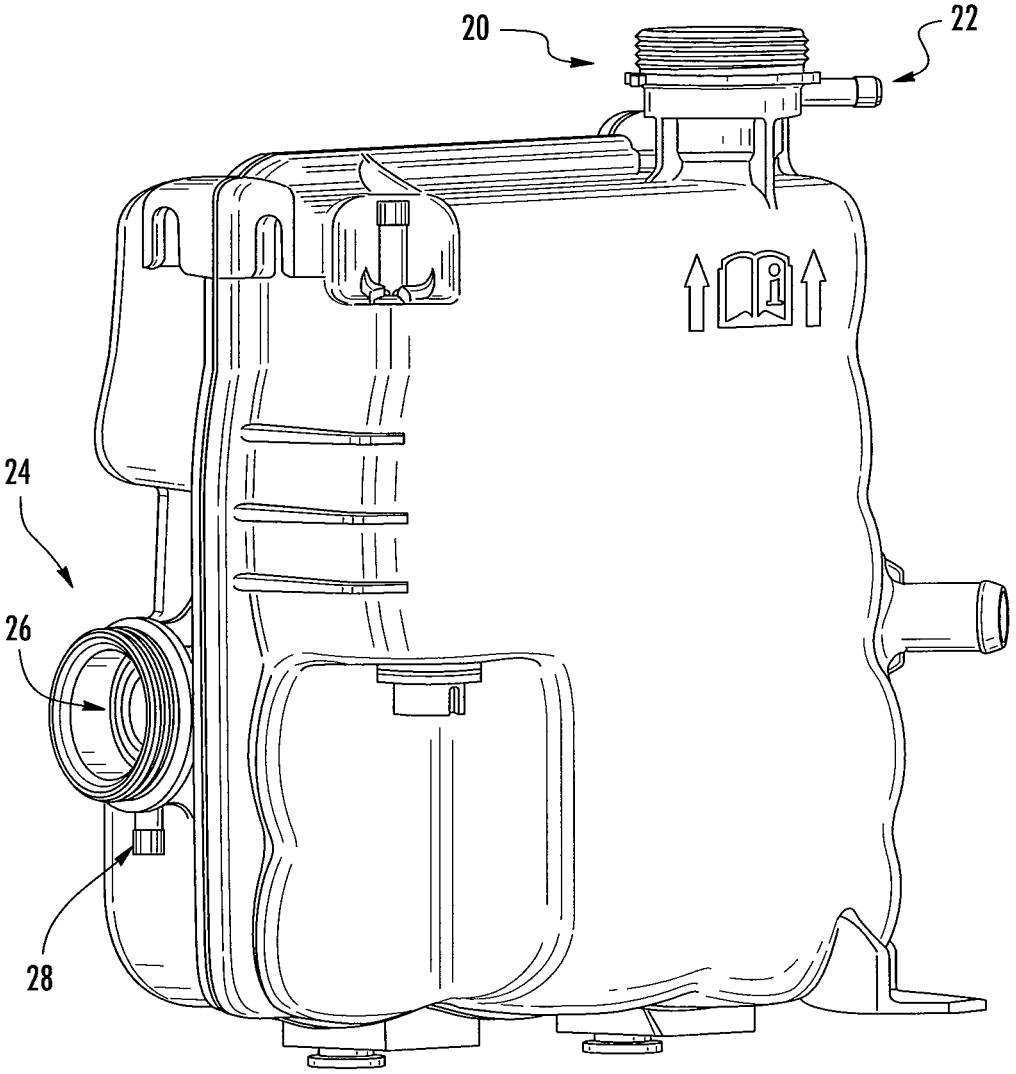
FIG. 2 (PRIOR ART)
FIG. 2 illustrates a rear view of FIG. 1.

Coolant systems used in more recent engines pressurize the coolant reservoir. By way of example, FIGS. 1 and 2 illustrate a prior art coolant reservoir 10 which includes a container having an upper fluid reservoir 12 and a lower fluid overflow 14. Excess coolant is relieved from the upper fluid reservoir 12 through an overflow channel 16. In operation, when the engine cools down, the engine will form a vacuum that draws coolant from the lower fluid overflow 14 back into the upper fluid reservoir 12. In addition, a pressure relief trough 18 is employed. If a cap placed upon the top fill neck 20 is opened while the coolant is hot, air pressure is relieved through the overflow channel 18 and air will escape out of the overflow port 22 instead of spraying the individual opening the cap. A vent neck 24 is positioned along the side of the reservoir with a pressure relief vent cap, not shown, placed on the vent neck 24 for sealing of the pressurized system. A relief hole 26 releases pressure through the pressure relief cap and through the vent neck port 28. The vent neck 24 uses a conventional two o-ring cap wherein pressure in excess of 20 psi can be released from the reservoir, or any pressure of design.

Figure 3:
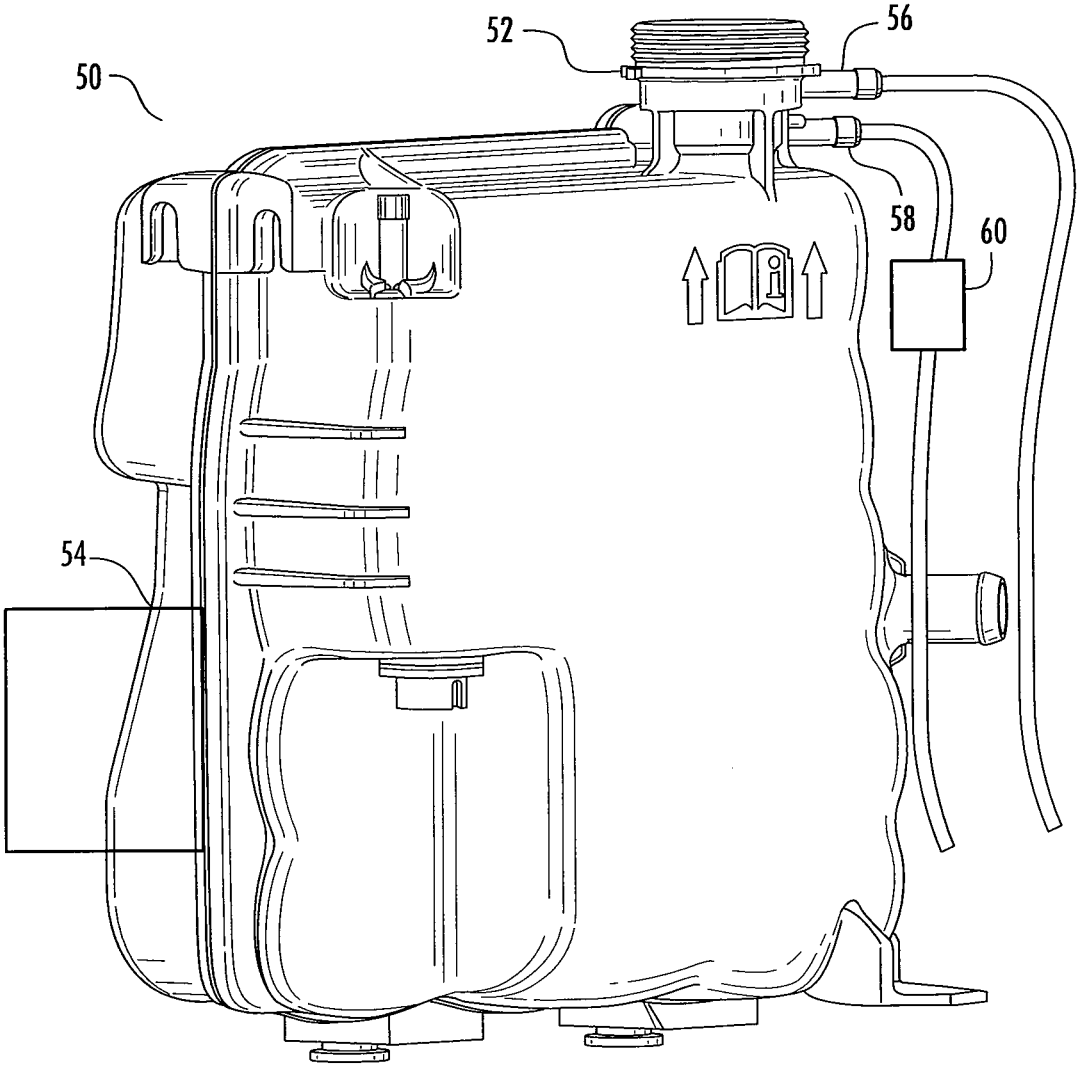
FIG. 3 illustrates a single cap coolant reservoir of the instant invention.

Referring to FIG. 3, set forth is the coolant reservoir 50 of the instant invention having a single vent neck 52. Noticeably absent is the second vent neck, typically located along the lower side surface 54 of the reservoir. In this embodiment, a pressure relief port 56 is positioned alongside a venting port 58. Venting port 58 is fluidly coupled to a check valve 60.

Figure 4:
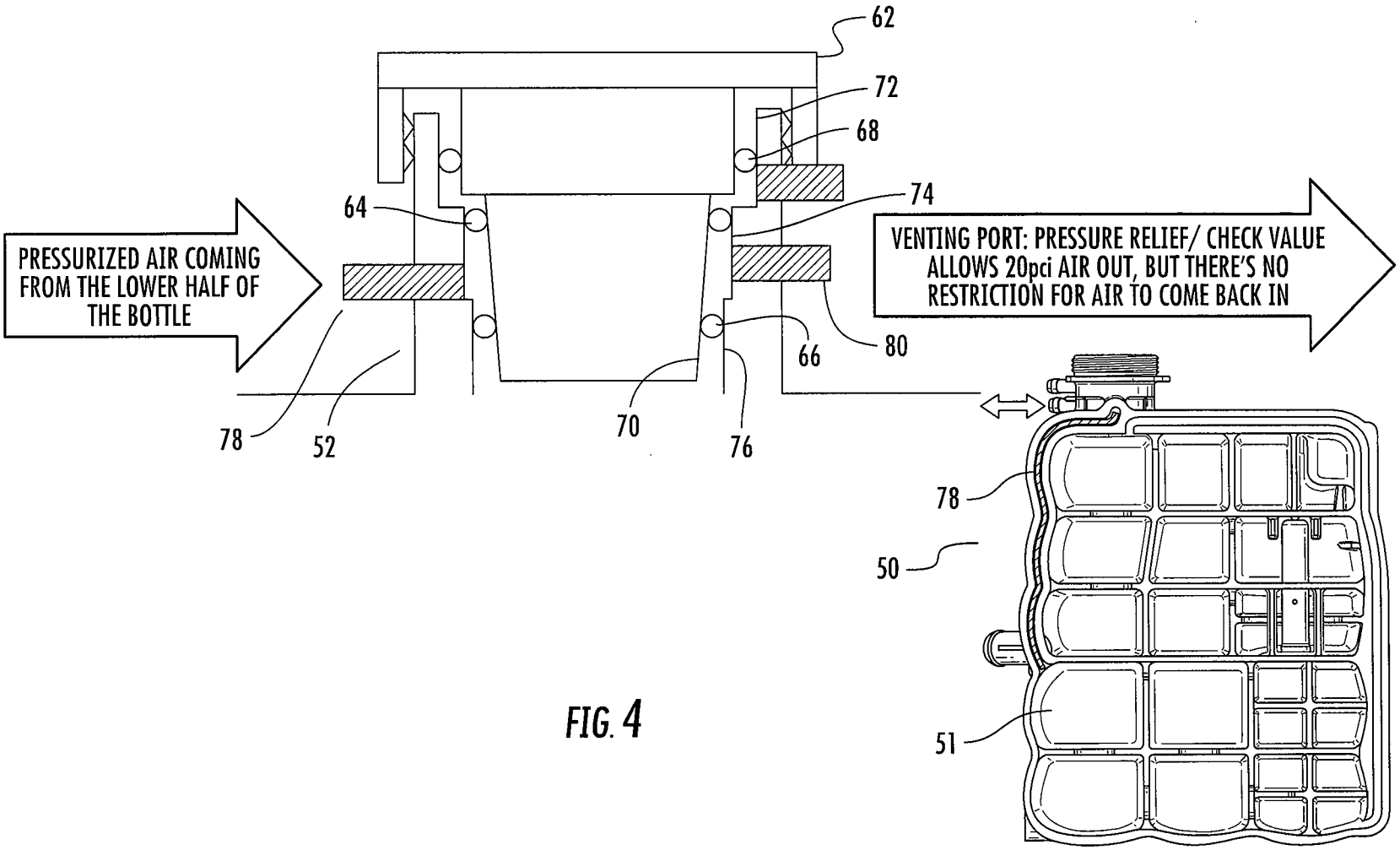
FIG. 4 illustrates the single cap coolant reservoir having a three o-ring design placed in a closed position.

FIG. 4 depicts the vent neck 52, wherein pressurized air from the fluid overflow second chamber 51 of the reservoir 50 is directed through the trough 78 passing between the first o-ring 64 and second o-ring 66 to venting port 80. The cap 62 in this embodiment is a three o-ring design, having a first o-ring 64, a second o-ring 66 and third o-ring 68. When the cap is closed, as illustrated, the o-rings 64, 66 and 68 seal between the cap surface and stepped side walls 72, 74 and 76. Pressurized air that enters the vent neck 52 from the second chamber into the port 78 would be directed through the venting port 80, that will include a pressure relief and check valve, that allows 20 psi pressure and above to escape. There is no restriction for air to be drawn back into the reservoir.

Figure 5:
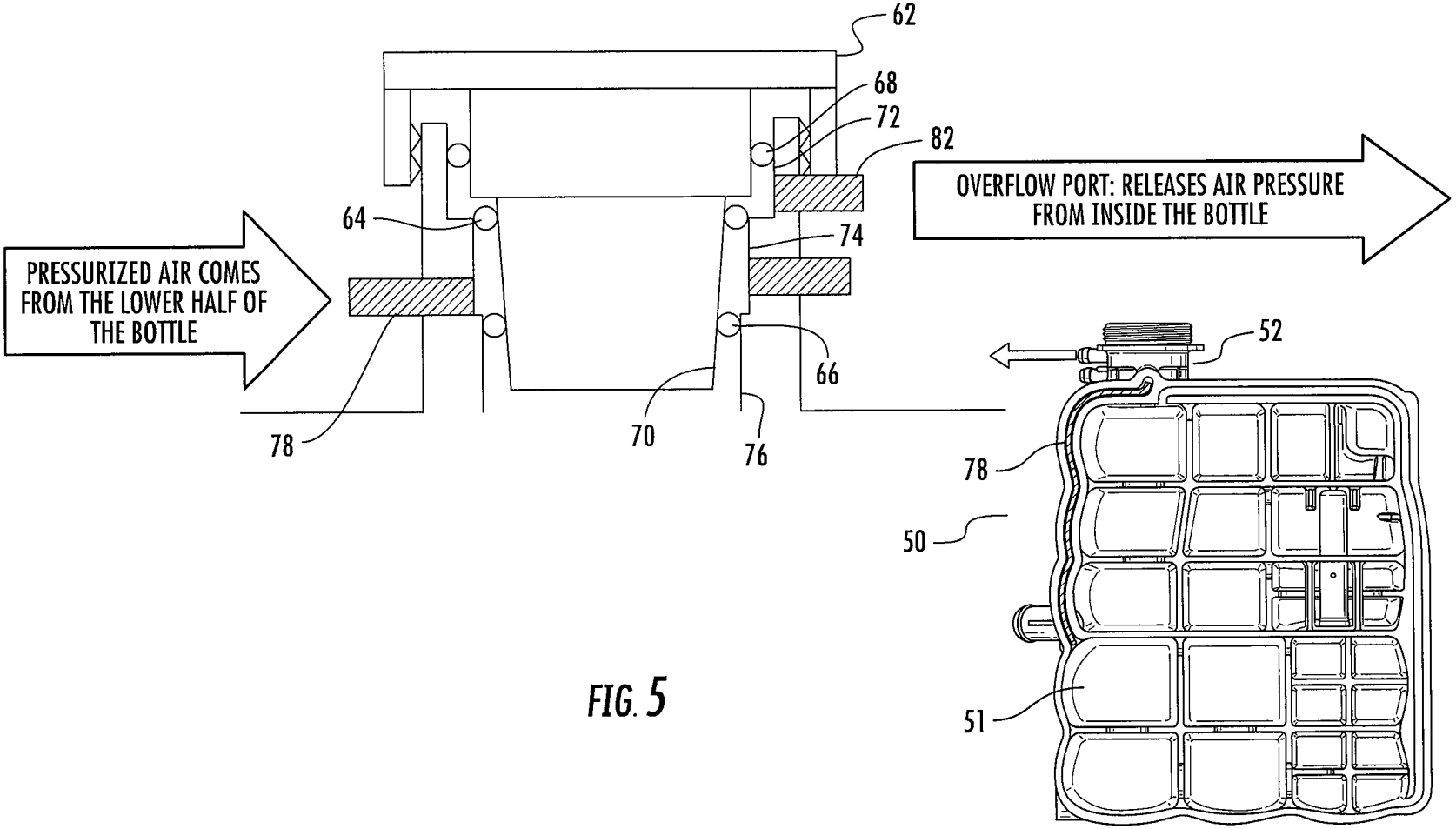
FIG. 5 illustrates the single cap coolant reservoir with the cap having a first o-ring disengaged.

Referring to FIG. 5, cap 62 has been rotated to a position where the first o-ring 64 disengages stepped side wall 74, wherein pressurized air from the lower section 51 of the reservoir 50 is allowed to vent through the trough 78 to the overflow port 82 uninhibited, thereby releasing air pressure from inside the reservoir to the atmosphere. It is noted that the second o-ring 66 and third o-ring 68 remain engaged between side wall 70 and stepped side walls 74 and 72.

Figure 6:
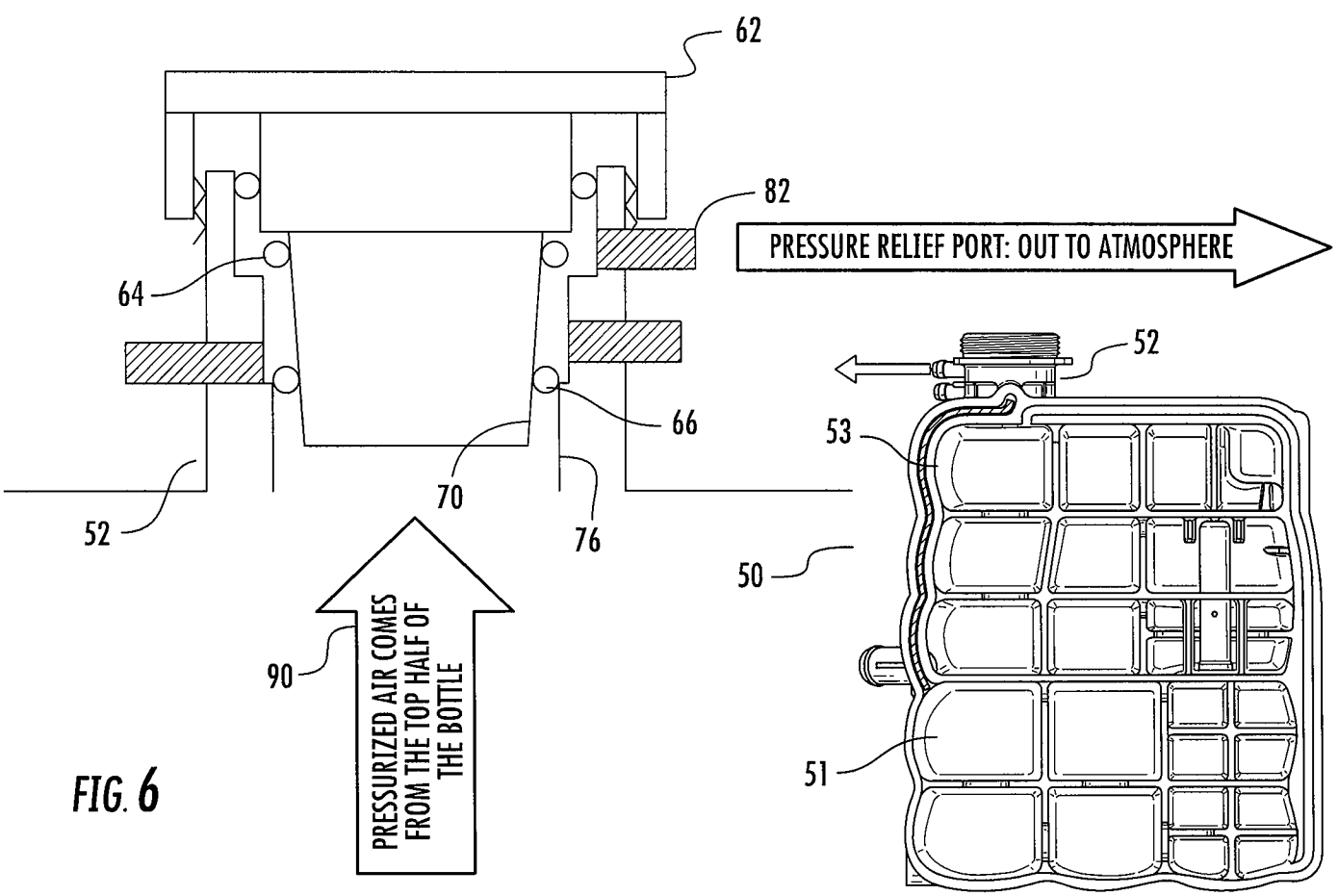
FIG. 6 illustrates the single cap coolant reservoir with the cap having a second o-ring disengaged.

Referring to FIG. 6, cap 62 is placed in a further open position, wherein first o-ring 64 is disengaged, and second o-ring 66 is now disengaged from side wall 70 and stepped side wall 76. In this position, pressurized air from the upper section 53 of the reservoir 50 enters the bottom of the vent cap 62 and is allowed to bypass both the first o-ring 64 and the second o-ring 66 to enter the overflow port 82 for uninhibited release to the atmosphere.

Figure 7:
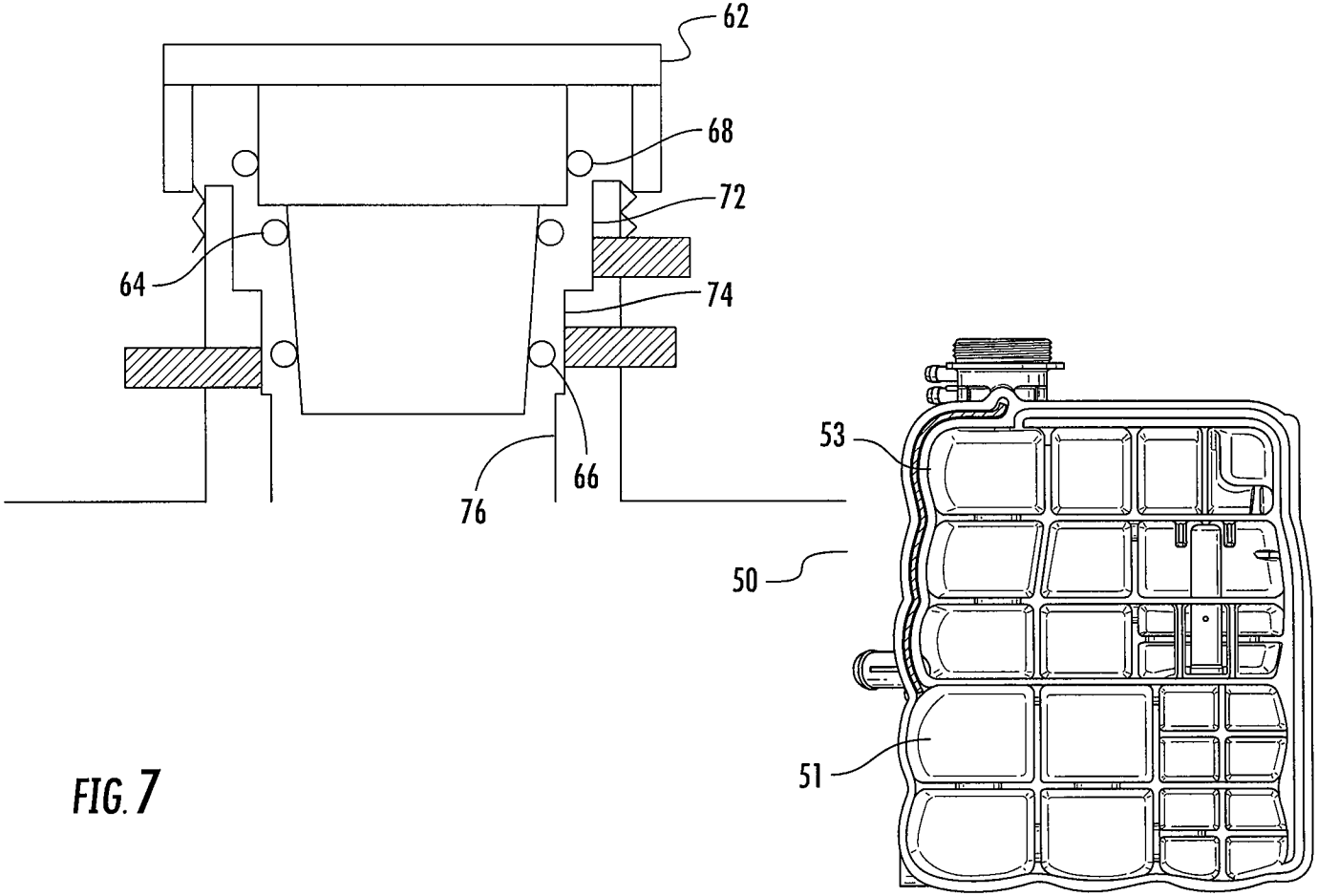
FIG. 7 illustrates the single cap coolant reservoir with the cap having the third o-ring disengaged.

Referring now to FIG. 7, the cap 62 is placed into a third position, which is an open position. In this position, first o-ring 64, second o-ring 66, and third o-ring 68 are no longer engaging side walls 76, 74, or 72 and all pressure would have been relieved before the third o-ring 68 is disengaged.

Figure 8:
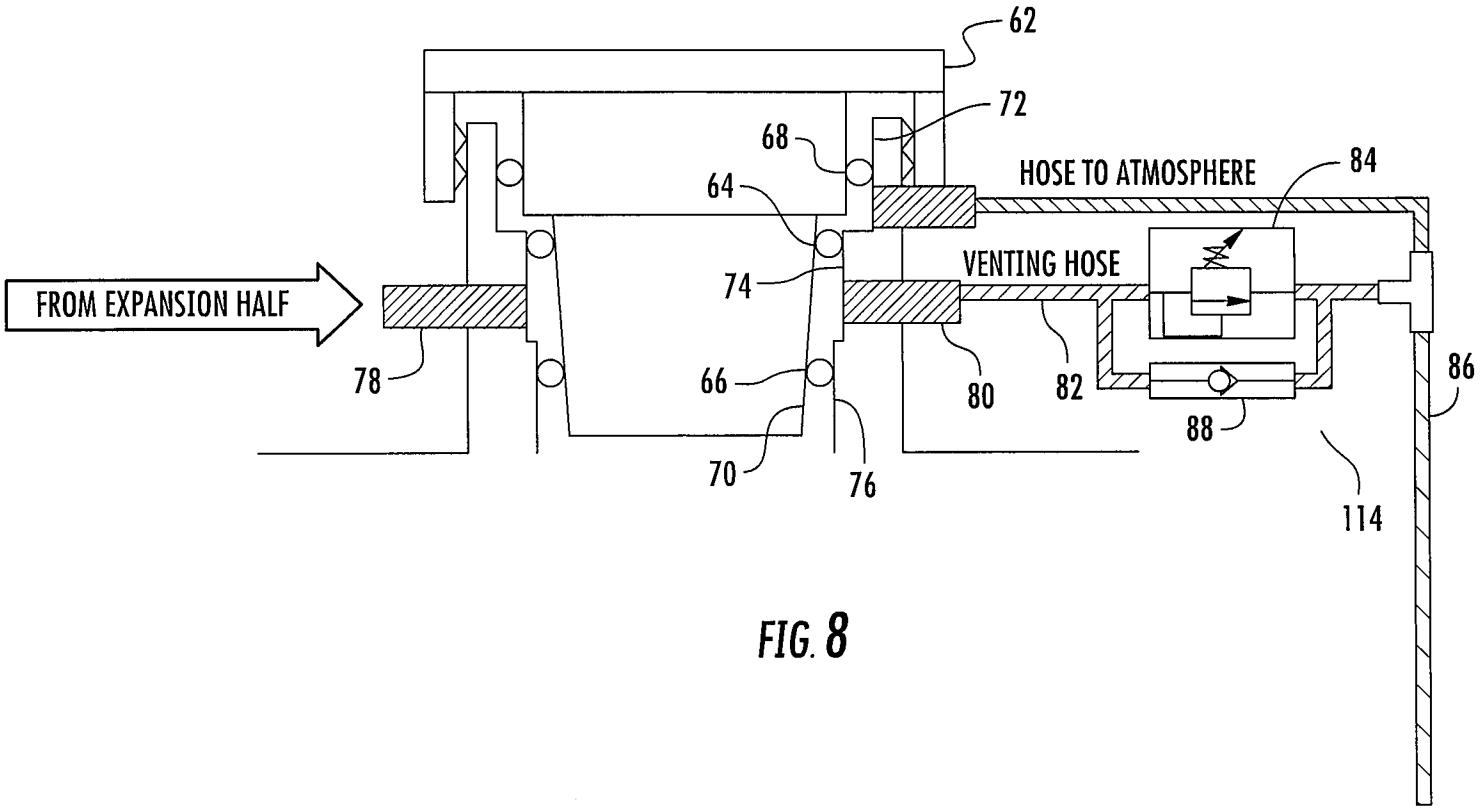
FIG. 8 illustrates the three o-ring cap hose routing with in-line pressure relief.

Referring to FIG. 8, depicted is the cap 62, with first o-ring 64, second o-ring 66 and third o-ring 68 engaged between side wall 70 and stepped side walls 72, 74 and 76. In this illustration, pressurized air coming into the port from the second chamber of the reservoir 78 is directed through the venting port 80 into a venting hose where it is placed in parallel with a pressure relief valve 84, which allows release of pressure from the venting hose to the exhaust hose 86 at a pre-determined pressure, in this embodiment 5-20 psi. In addition, a check valve 88, placed in parallel with the pressure relief valve 84, prevents pressurized air directed through the venting hose to escape through the check valve in a single direction, forcing pressurized air to be released, if over 20 psi, through the pressure relief valve 84 to the exhaust hose 86. In conditions where the engine is cooling off, the check valve allows air to re-enter the system through the exhaust line 86, and back in through the venting hose 82, passing through the check valve 88 without restriction. In a preferred embodiment, the pressure relief and check valve constitute a single valve placed in line with the venting hose. The pressure relief valve can be set at a predetermined relief pressure or be an adjustable valve wherein the pressure relief can be mechanically adjusted.

Figure 9:
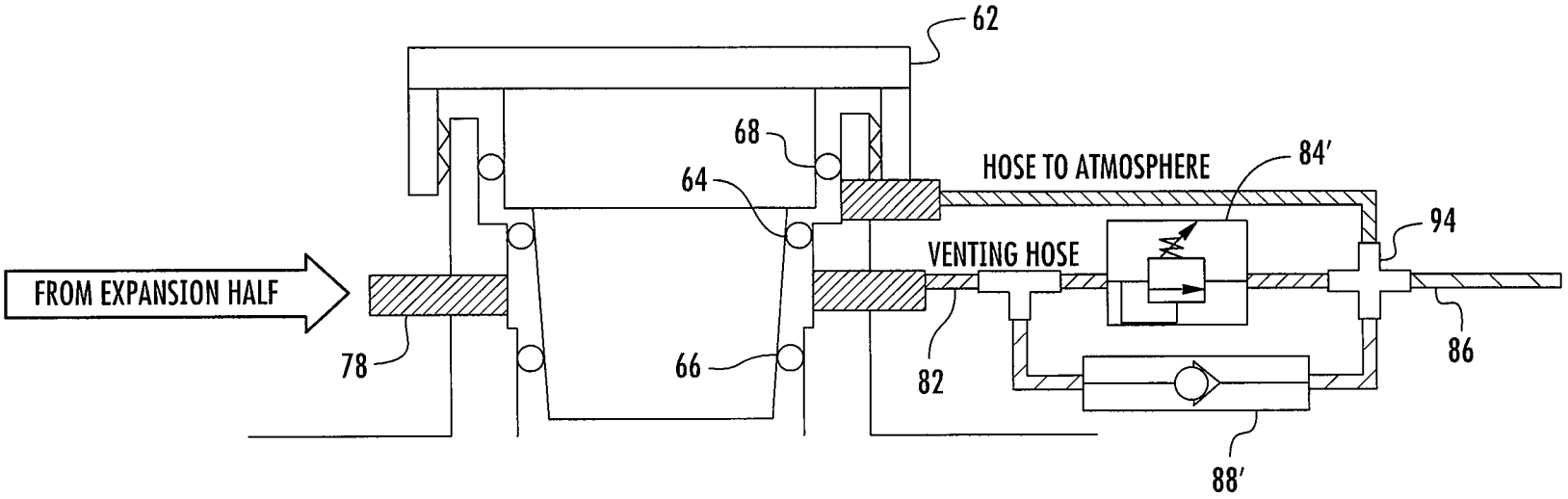
FIG. 9 illustrates the three o-ring cap hose routing with in-line pressure relief if a single valve cannot be used.

Referring to FIG. 9, set forth is another embodiment having the cap 62 engaging o-ring seals 64, 66 and 68. In this embodiment, the pressure relief valve 84' is placed in parallel with check valve 88' in line with the venting hose, which allows fluid from escaping through expansion half to an exhaust line 86. In this embodiment, the use of a single valve is replaced with two independent valves; the exhaust of each is coupled together by a union 94.

Figure 10:
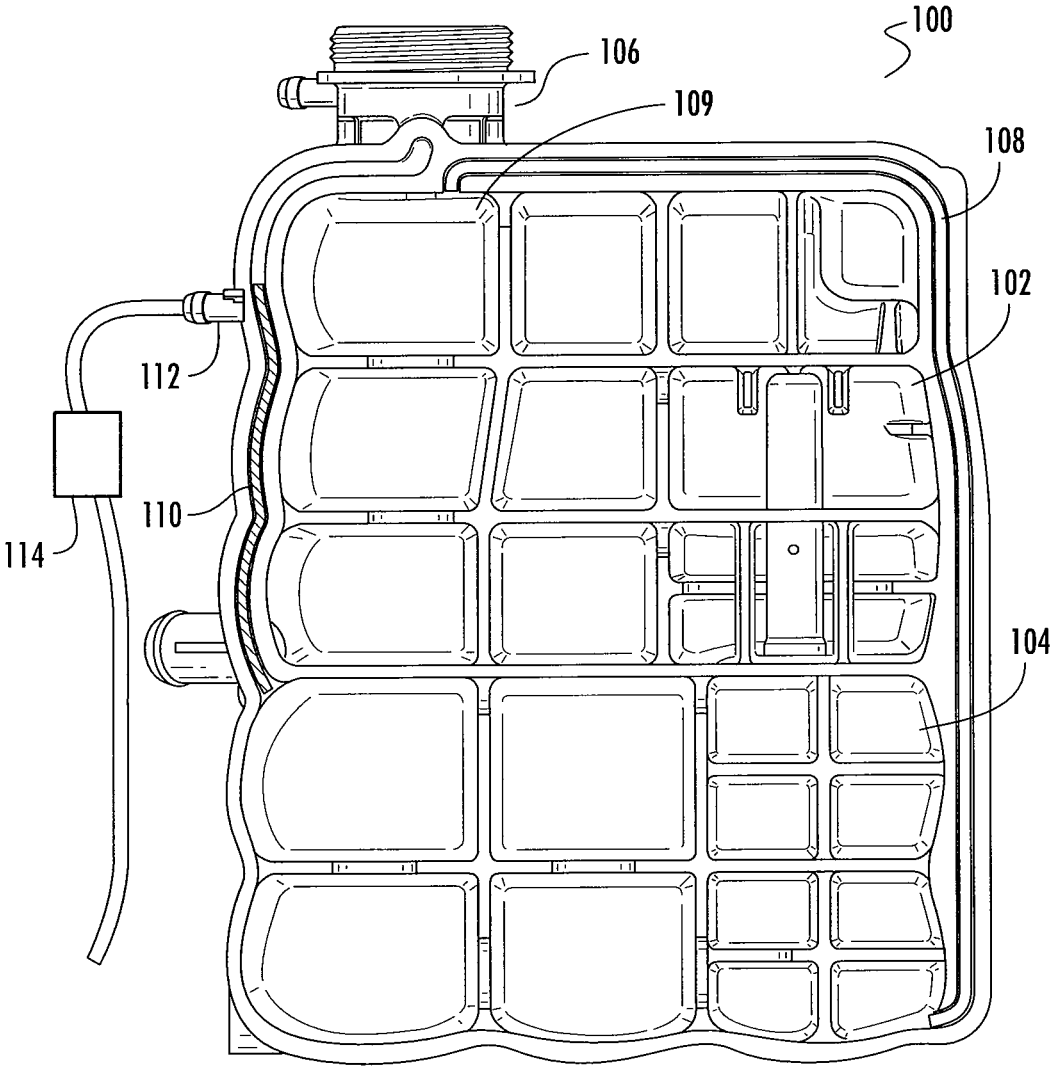
FIG. 10 illustrates a single cap coolant reservoir with a two o-ring seal.

Referring now to FIG. 10, set forth is an embodiment depicting the coolant reservoir 100, an upper section 102, a lower section 104, and a vent neck 106. In this embodiment, the vent trough 108 extends from an upper portion 109 of the upper section 102, to the lower section 104. A second trough 110 extends from the lower section 104 and, unlike the previous embodiment, the trough 110 is discontinued at vent port 112 so as not to extend to the vent neck 106. In this embodiment, pressure relief and check valve 114 is secured to the vent port 112.

Figure 11:
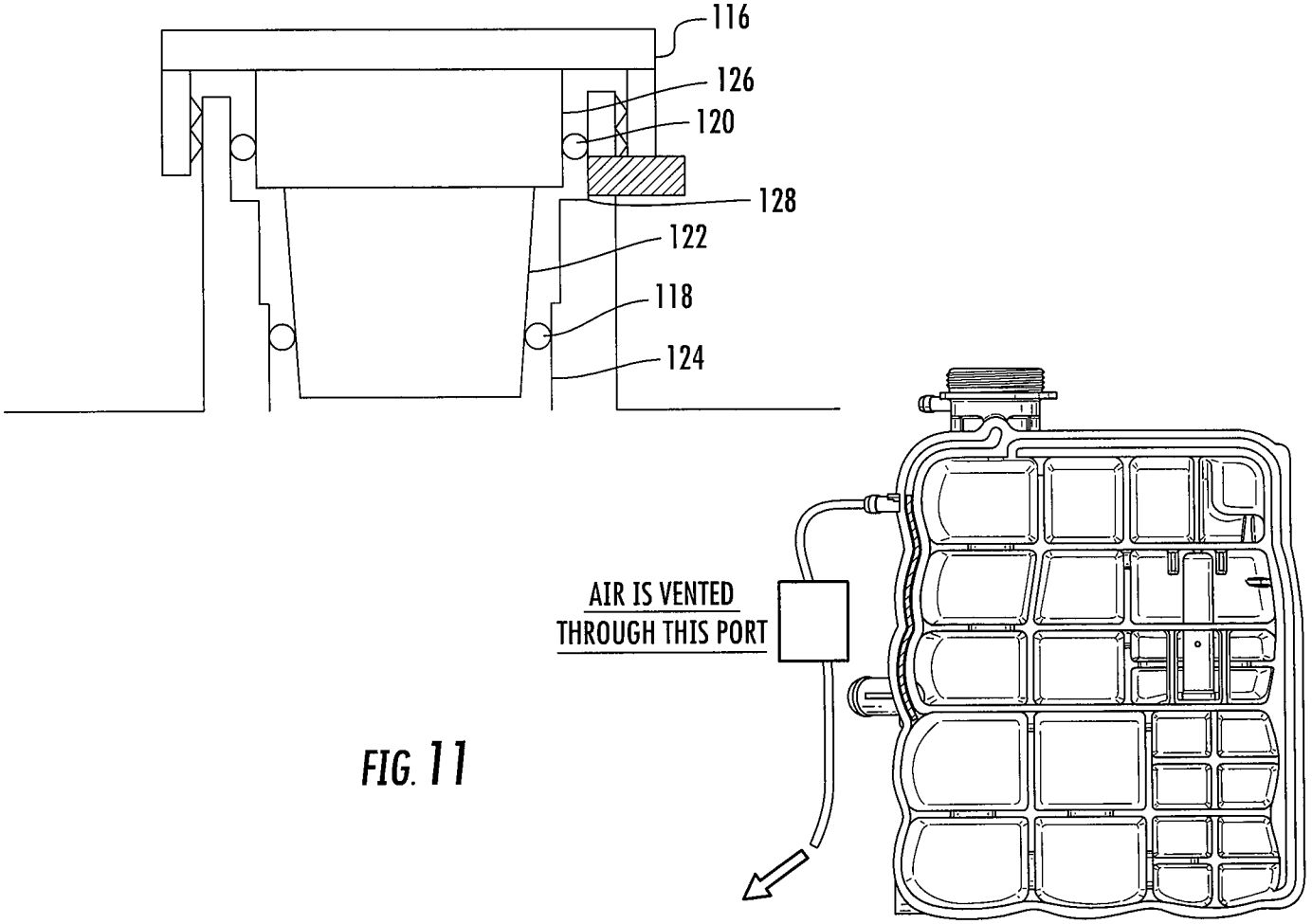
FIG. 11 illustrates the two o-ring single cap coolant reservoir with the cap closed.

Referring now to FIG. 11, cap 116 having a first o-ring seal 118 and a second o-ring seal 120 is depicted. The first seal provides a seal between side wall 122 and step wall 124. The second o-ring seal 120 provides a seal between side wall 126 and step wall 128. When the cap is closed, no air is directed to the cap section and, as shown in FIG. 10, air is vented through the pressure relief/check valve 114 should any excess pressure above 20 psi expand from the lower section 104.

Figure 12:
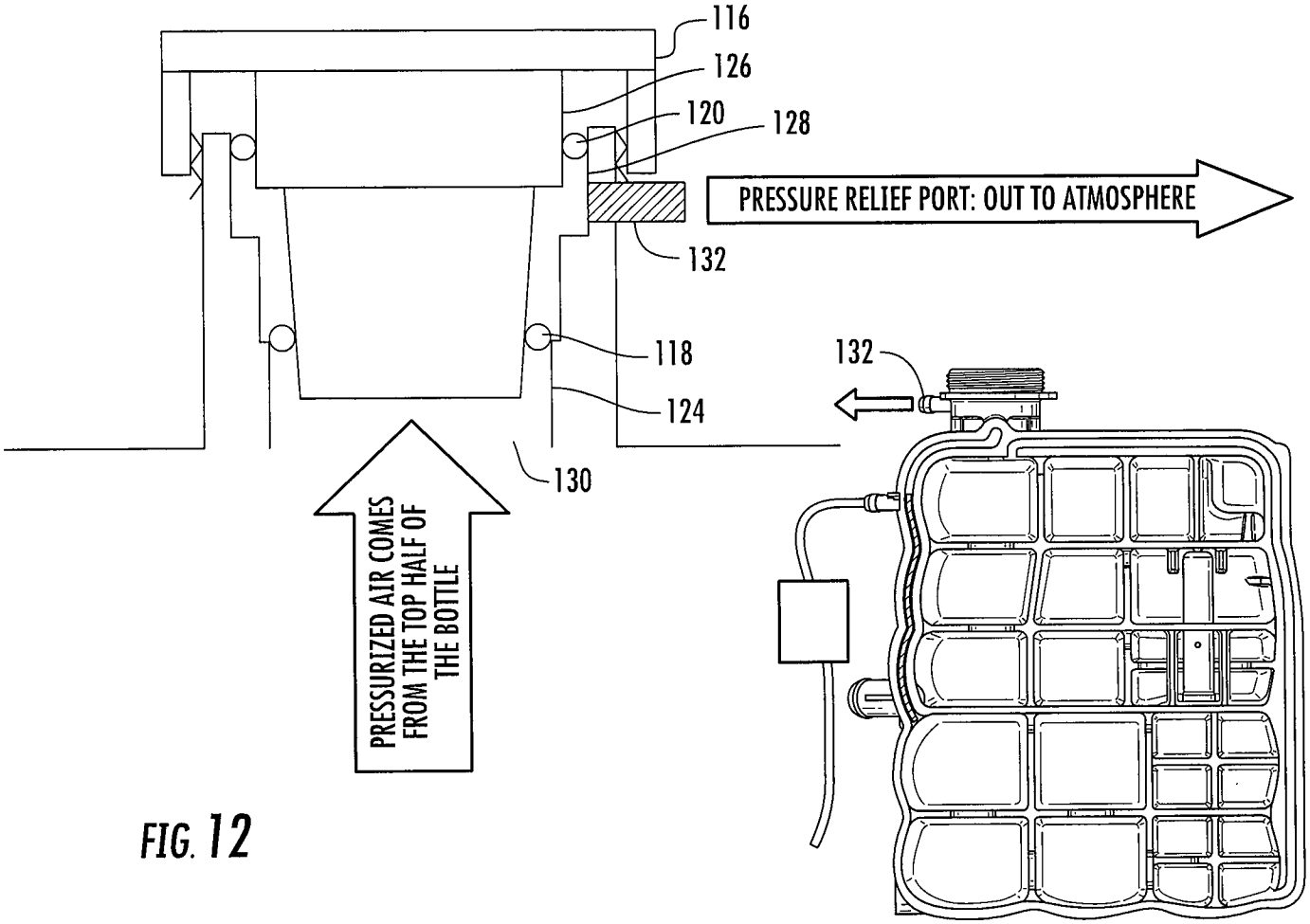
FIG. 12 illustrates the two o-ring single cap coolant reservoir with the first o-ring disengaged.

Referring to FIG. 12, set forth is an illustration with the cap 116 in a first position wherein first o-ring seal 118 no longer engages side wall 124 and pressurized air from the top of the reservoir can enter the cap area through the opening 130 and escape through relief port 132. The second o-ring seal 120 remains engaged with side wall 126 and step wall 128.

Figure 13:
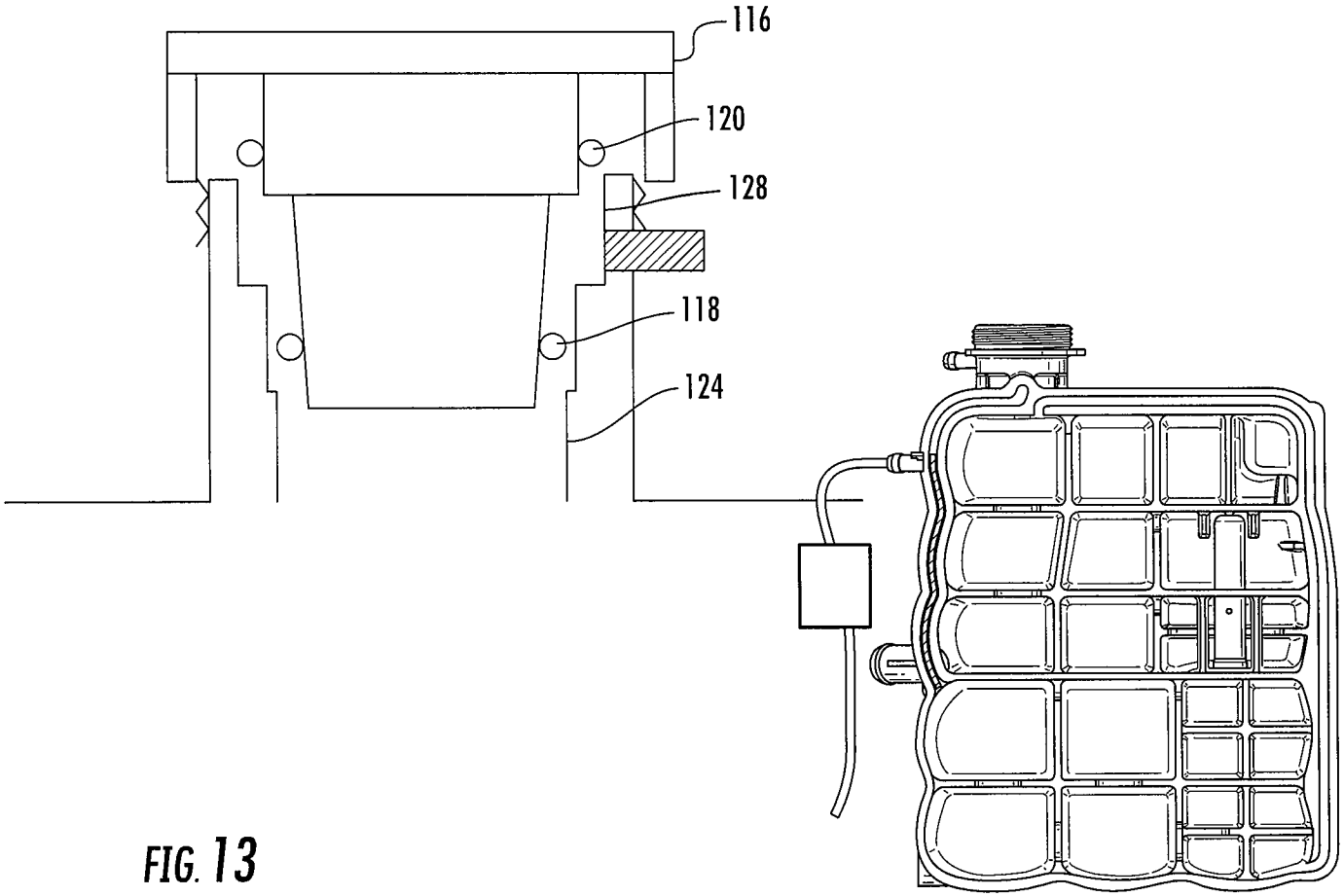
FIG. 13 illustrates the two o-ring single cap coolant reservoir with the second o-ring disengaged.

Referring to FIG. 13, the cap 116 is placed in a position so that first o-ring 118 and second o-ring seal 120 no longer engage step side walls 128 or 124. In this position all pressure has been relieved before the second o-ring 120 disengages.

Figure 14:
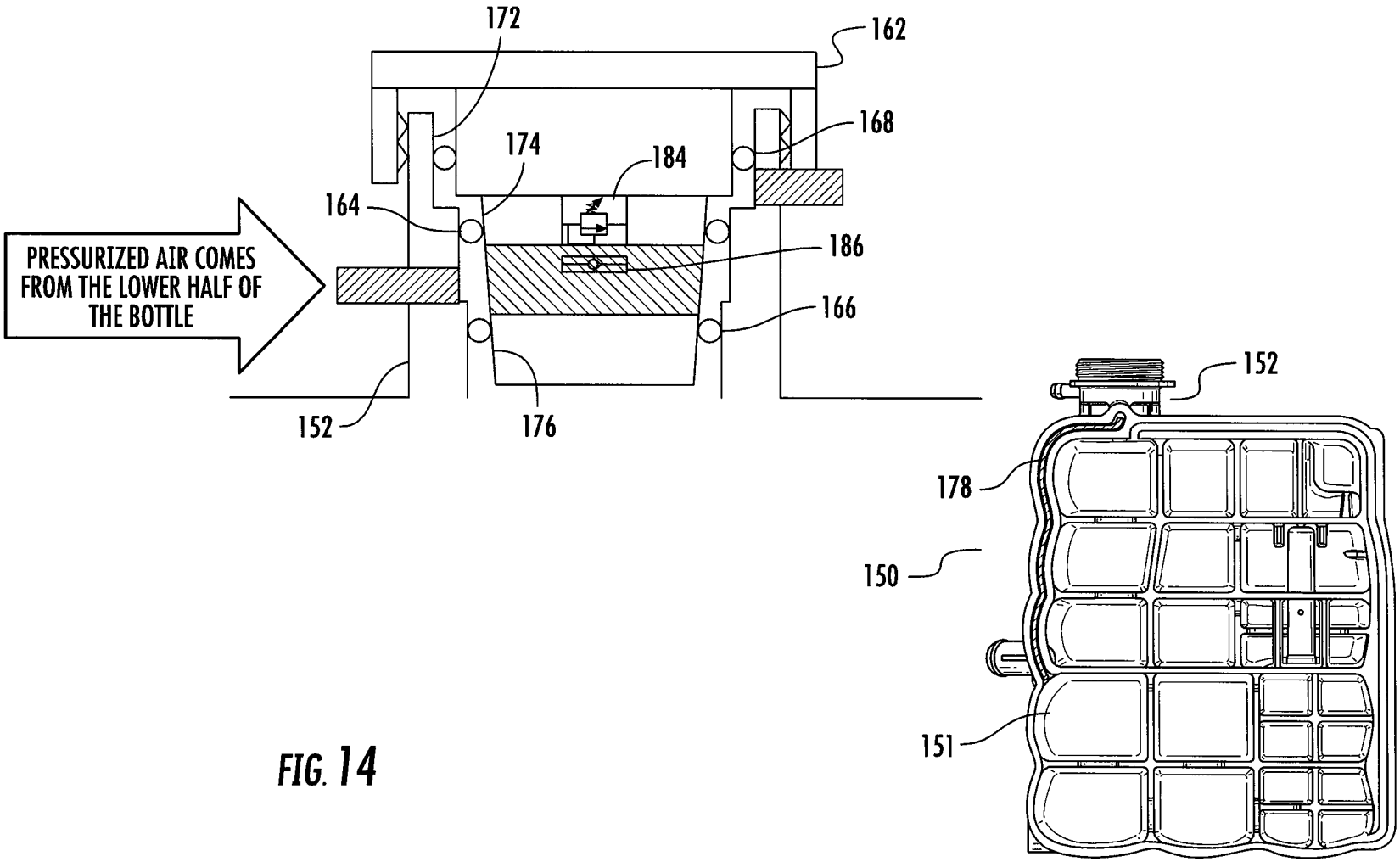
FIG. 14 illustrates a three o-ring single cap coolant reservoir with an internal relief valve and check valve.
Figure 15:
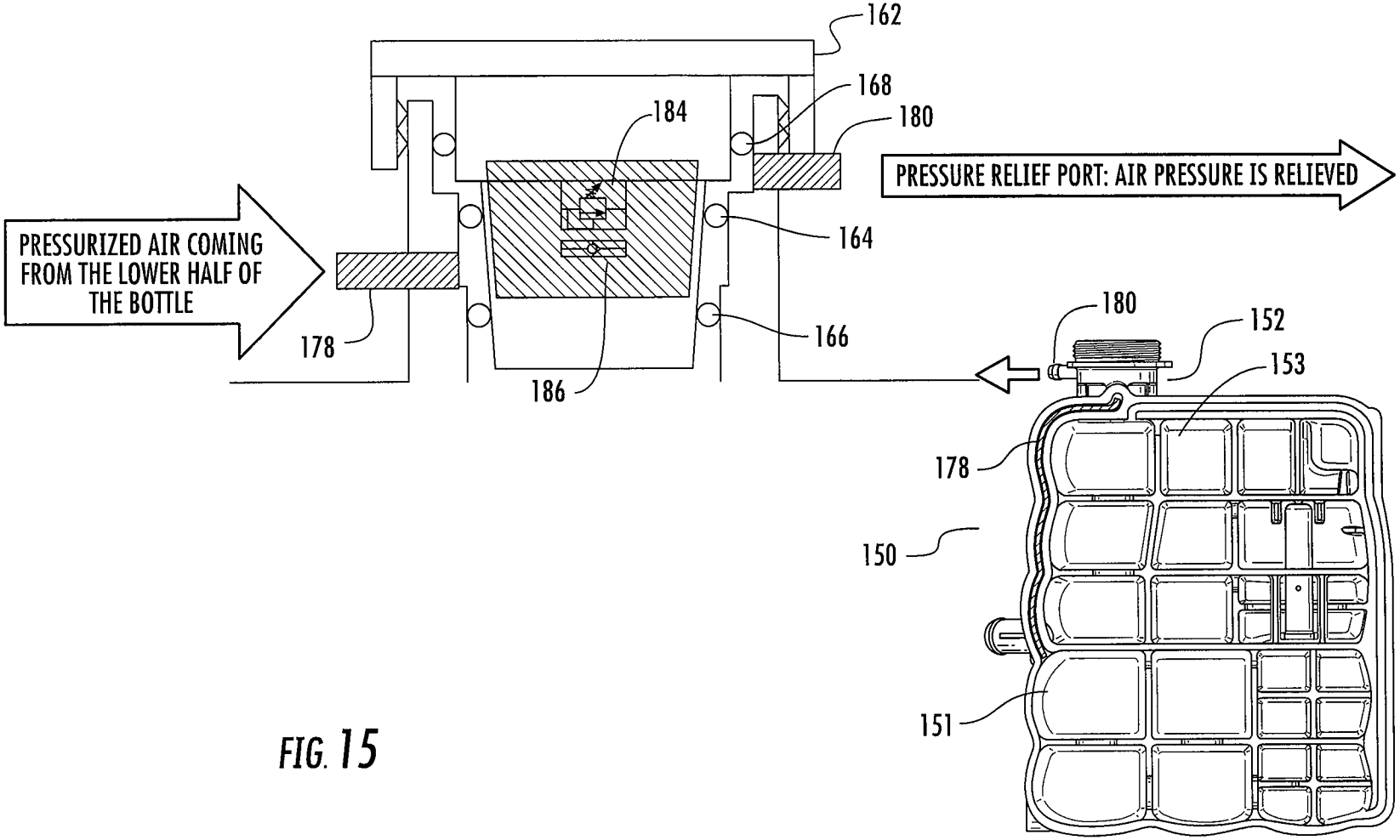
FIG. 15 is a further depiction of FIG. 14 illustrating pressure release.

Referring to FIGS. 14-18, set forth is another embodiment wherein the pressure relief valve and check valve are formed integral with a cap. FIG. 14 depicts the vent neck 152, wherein pressurized air from the fluid overflow second chamber 151 of the reservoir 150 is directed through the trough 178 passing between the first o-ring 164 and second o-ring 166 with relief valve 184 preventing release of a pressure beneath 20 psi or the like predetermined pressure. While the preferred embodiment is to employ a predetermined pressure relief valve, the 20 psi valve is simply for illustration purposes only. The pressure can be any predetermined value and, as may also consist of a mechanism to allow for adjustment of the pressure relief valve. The cap 162 in this embodiment is a three o-ring design, having a first o-ring 164, a second o-ring 166 and third o-ring 168. When the cap is closed, as illustrated, the o-rings 164, 166 and 168 seal between the cap surface and stepped side walls 172, 174 and 176. Pressurized air that enters the vent neck 152 from the second chamber 151 into the trough 178 would trapped by the pressure relief valve 184. Check valve 186 prevents pressurized fluid from escaping through the check valve with no restriction for air to be drawn back into the reservoir. Referring to FIG. 15, cap 162 is illustrated being subjected to pressure exceeding 20 psi, or any pressure of design, wherein excess pressure is expelled through vent port 180 positioned between the first o-ring 164 and the third o-ring 168.

Figure 16:
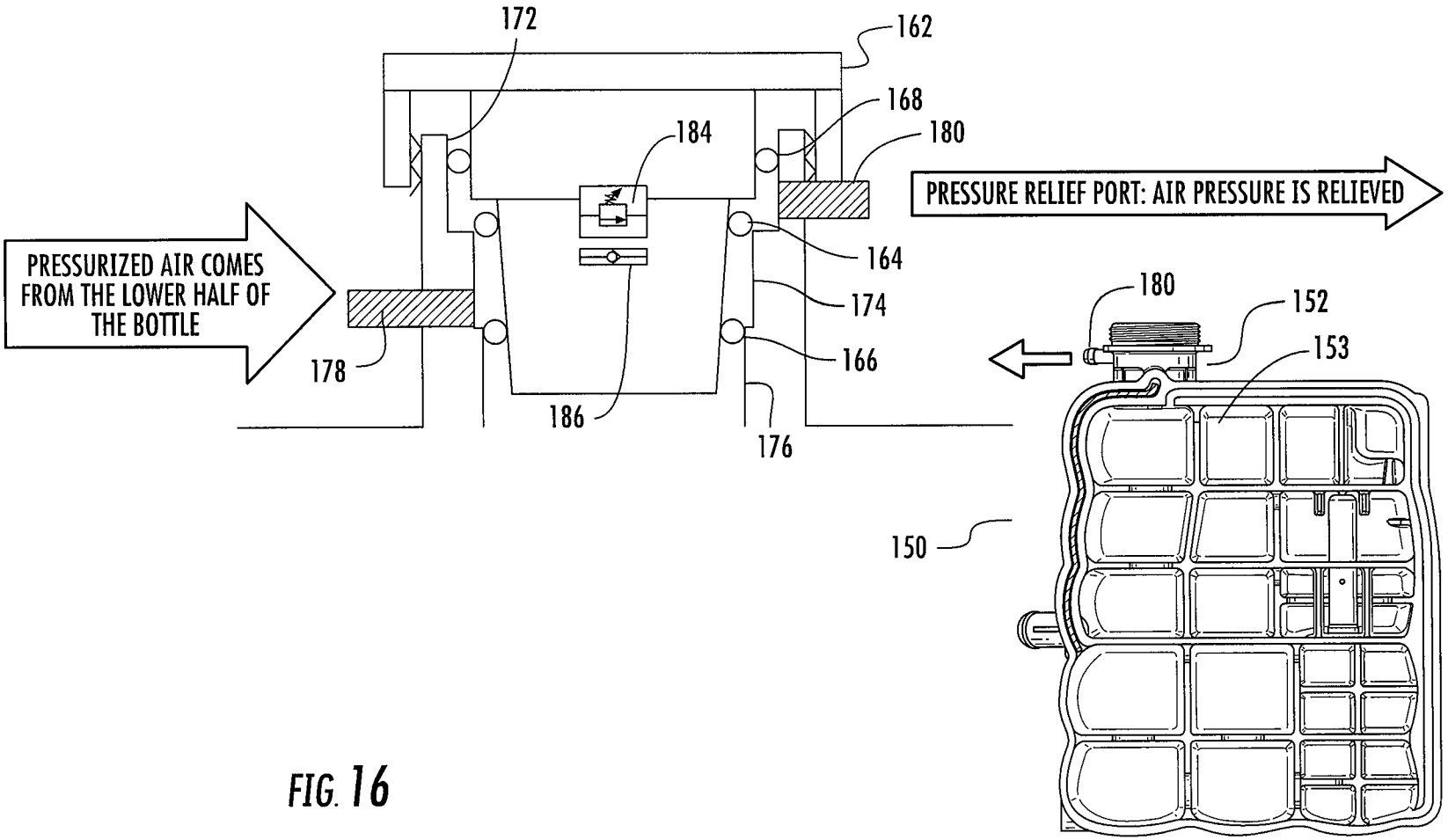
FIG. 16 illustrates the three o-ring single cap coolant reservoir with the first o-ring disengaged.

Referring to FIG. 16, cap 162 has been rotated to a position where the first o-ring 164 disengages stepped side wall 174, wherein pressurized air from the lower section 151 of the reservoir 150 is allowed to vent through the trough 178 to the vent port 180 uninhibited, thereby releasing air pressure from inside the reservoir to the atmosphere. It is noted that the second o-ring 166 and third o-ring 168 remain engaged between side wall 170 and stepped side walls 174 and 172.

Figure 17:
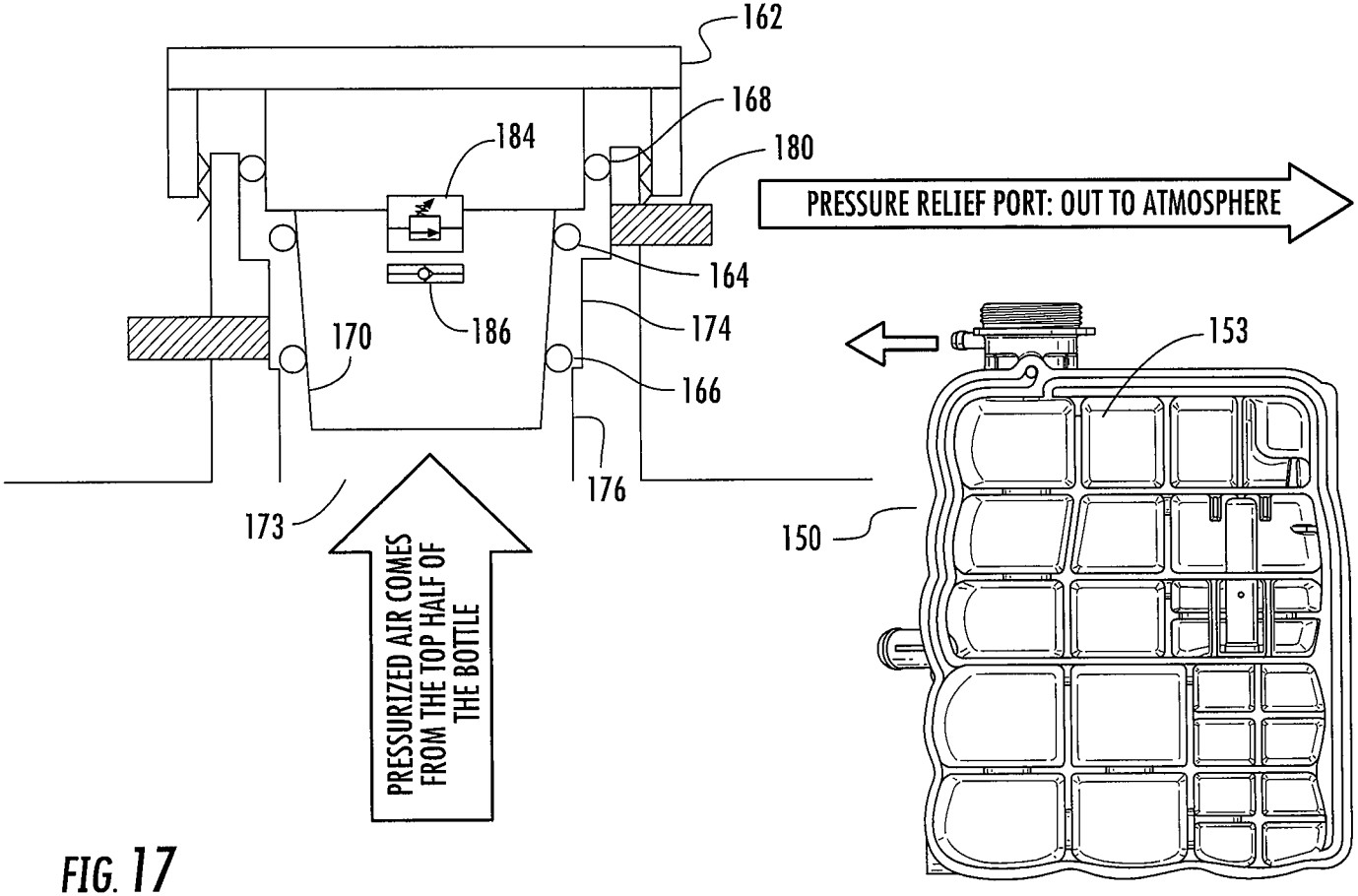
FIG. 17 illustrates the three o-ring single cap coolant reservoir with the second o-ring disengaged.

Referring to FIG. 17, cap 162 is placed in a further open position, wherein first o-ring 164 is disengaged, and second o-ring 166 is also disengaged from side wall 170 and stepped side wall 176. In this position, pressurized air from the upper section 153 of the reservoir 150 enters the bottom of the vent cap 173 and is allowed to bypass both the first o-ring 164 and the second o-ring 166 to enter the vent port 180 for uninhibited release to the atmosphere.

Figure 18:
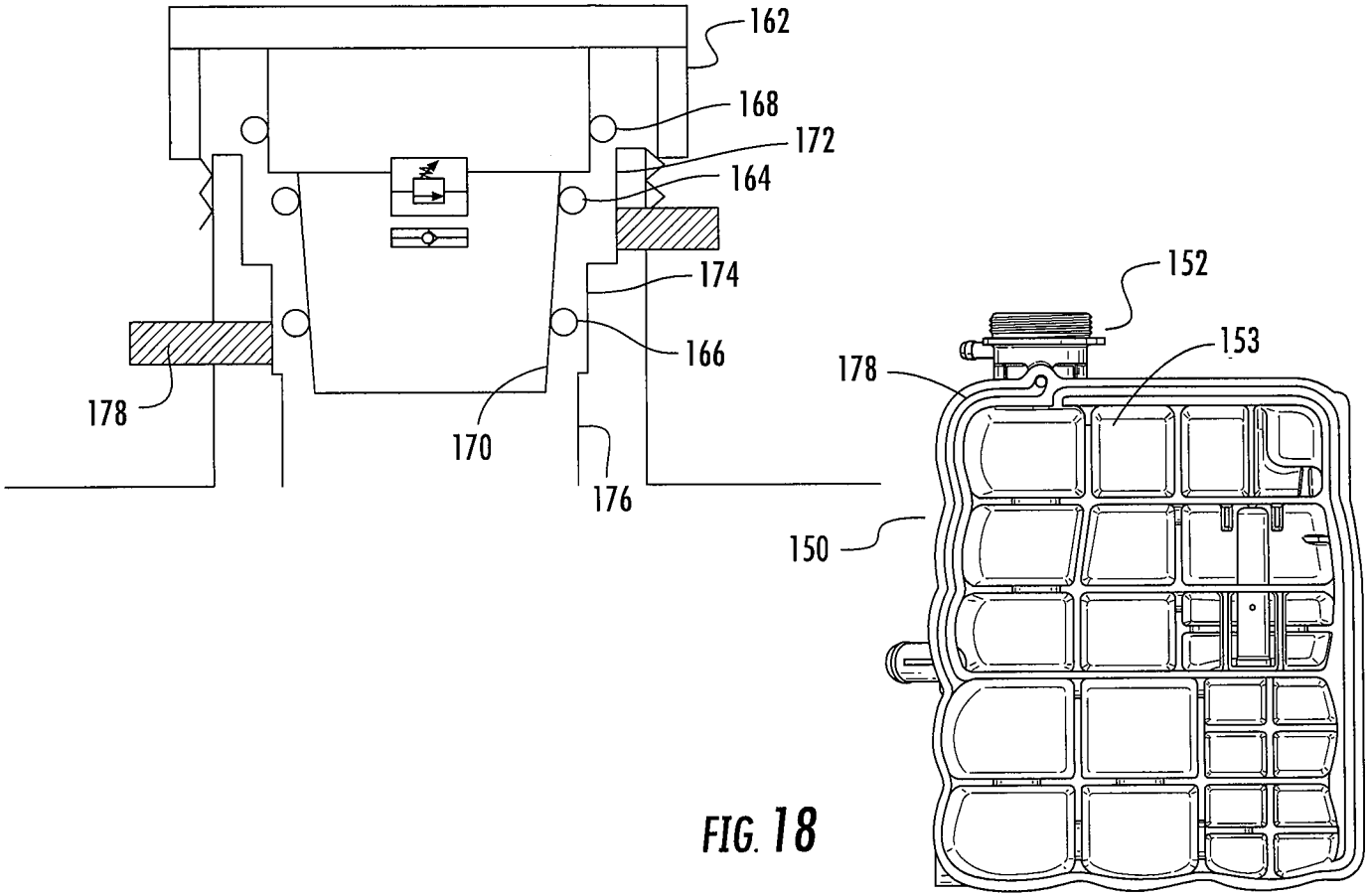
FIG. 18 illustrates the three o-ring single cap coolant reservoir with the third o-ring disengaged.

Referring to FIG. 18, the cap 162 is placed into a third position, which is an open position. In this position, first o-ring 164, second o-ring 166, and third o-ring 168 are no longer engaging side walls 176, 174, or 172 and all pressure would have been relieved before the third o-ring 168 is disengaged.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A coolant reservoir for a fluid cooling system comprising:

a reservoir housing having a primary chamber positioned above an overflow chamber, said primary chamber fluidly connected to said overflow chamber by a first trough extending from a top wall of said primary chamber to a bottom wall of said overflow chamber;

a vent neck formed integral to said primary chamber having an outer wall and an inner sidewall, said inner sidewall having a lower portion defining a first diameter with a centrally disposed aperture constructed and arranged to allow filling of said primary chamber with fluid, said vent neck having a middle portion having a second diameter dimensioned greater than said first diameter, said middle portion of said vent neck connected to a top wall of said overflow chamber by a second trough, an upper portion of said vent neck having an inner sidewall forming a third diameter having a diameter greater than said middle portion, said vent neck constructed and arranged to receive a vent cap;

a first venting port extending from said middle portion of said vent neck, said first venting port coupled to a relief valve vented to atmosphere;

a second venting port extending from said upper portion of said vent neck and vented to atmosphere;

said vent cap removably attached to said vent neck aperture, said vent cap having a top with a vertical sidewall depending therefrom and a lower conical shaped sidewall depending from beneath said vertical sidewall, a first o-ring is secured to an upper portion of said lower conical shaped sidewall, a second o-ring is secured to a lower portion of said lower conical shaped sidewall, and third o-ring is secured to said vent cap vertical sidewall; said vent cap further comprising said relief valve and a check valve;

wherein said primary chamber is filled with fluid through said vent neck aperture when said vent cap is detached from said vent neck;

wherein full securement of said vent cap to said vent neck aligns said first venting port between said first and second o-rings whereby pressurized air from said overflow chamber is exhausted into said first venting port and through said relief valve, said check valve allowing air to return to said overflow chamber when fluid has been displaced from said overflow chamber and said second venting port allowing air to be expelled from said primary chamber when fluid is introduced to said primary chamber;

wherein partial securement of said vent cap in a first position to said vent neck positions said first o-ring between said middle and upper portion of said vent neck and pressurized air from said overflow chamber is exhausted through said second venting port to the atmosphere;

wherein partial securement of said vent cap in a second position to said vent neck positions said first o-ring in said upper portion of said vent neck and pressurized air from said primary chamber is exhausted through said second venting port to the atmosphere.

2. The coolant reservoir for a fluid cooling system according to claim 1 including a unidirectional check valve allowing atmospheric air to enter said overflow chamber.

3. The coolant reservoir for a fluid cooling system according to claim 1 wherein movement of said vent cap to a first position disengages said first O-ring allowing partial pressure release through said pressure relief valve, movement of said vent cap to a second position disengages said second O-ring allowing complete pressure release through said pressure relief valve while the third O-ring remains frictionally engaged to the sidewall preventing pressure from escaping around the cap cover.

4. The coolant reservoir for a fluid cooling system according to claim 1 wherein said relief valve set to relieve pressure at a predetermined value.

5. The coolant reservoir for a fluid cooling system according to claim 1 wherein said relief valve is adjustable.

6. The coolant reservoir for a fluid cooling system according to claim 1 wherein said relief valve is placed in-line with said first vent port.

7. The coolant reservoir for a fluid cooling system according to claim 1 wherein said relief valve is formed integral with said vent cap.

8. The coolant reservoir for a fluid cooling system according to claim 1 wherein said relief valve relieves pressure between 5-20 psi.

* * * * *